US006067995A

United States Patent [19]

Schneider et al.

[11] Patent Number: 6,067,995

[45] Date of Patent: May 30, 2000

[54] COAXIAL CIGARETTE HAVING CROSS STREAM BARRIER

[75] Inventors: Werner Schneider, Quickborn; Thomas Jung; Erwin Kausch, both of Bayreuth; Bernd Spallek, Syke; Gerald Schmekel, Elmshorn, all of Germany

[73] Assignee: Brown & Williamson Tobacco Corporation, Louisville, Ky.

[21] Appl. No.: 09/198,673

[22] Filed: Nov. 23, 1998

[30] Foreign Application Priority Data

Dec. 23, 1997 [DE] Germany ..... 197 57 712

[51] Int. Cl.[7] ..... A24B 1/00; A24B 1/04; A24B 15/00; A24D 3/04

[52] U.S. Cl. ..... 131/360; 131/361; 131/336; 131/338; 131/344; 131/331

[58] Field of Search ..... 131/360, 361, 131/362, 365, 358, 364, 331, 335, 336, 341, 344, 338

[56] References Cited

U.S. PATENT DOCUMENTS

| | | | |
|---|---|---|---|
| 3,046,994 | 7/1962 | Schur | 131/336 |
| 5,265,626 | 11/1993 | Schneider et al. | 131/341 |
| 5,439,011 | 8/1995 | Schneider | 131/360 |
| 5,730,160 | 3/1998 | Schneider | 131/364 |

FOREIGN PATENT DOCUMENTS

| | | |
|---|---|---|
| 0156628 | 2/1985 | European Pat. Off. . |
| 1792440 B2 | 11/1971 | Germany . |
| 3207683 A1 | 9/1983 | Germany . |
| 3521279 C2 | 8/1988 | Germany . |
| 3743597 | 2/1989 | Germany . |
| 3901226 | 7/1990 | Germany . |
| 4127420 A1 | 2/1993 | Germany . |
| 4444157 | 11/1995 | Germany . |

*Primary Examiner*—James Derrington
*Assistant Examiner*—Dionne A. Walls
*Attorney, Agent, or Firm*—Middleton & Reutlinger; John F. Salazar; Charles G. Lamb

[57] ABSTRACT

The invention relates to a coaxial cigarette including a rod comprising a rod core, a rod core wrapping, a rod jacket and a rod jacket wrapping; and a filter comprising a filter core, a filter core wrapping, a filter jacket and a filter jacket wrapping, a smoke flow stopper being provided between the rod core and the filter jacket and/or the rod jacket and the filter core in the zone joining the rod core wrapping and filter core wrapping, the invention also relating to a method of producing such a cigarette.

20 Claims, 3 Drawing Sheets

COAXIAL CIGARETTE HAVING CROSS STREAM BARRIER

BACKGROUND OF THE INVENTION

1. Field of the Invention

The invention relates to a coaxial cigarette including a rod comprising a rod core, a rod core wrapping, a rod jacket and a rod jacket wrapping; and a filter comprising a filter core, a filter core wrapping, a filter jacket and a filter jacket wrapping, wherein a cross stream barrier (smoke flow stopper) is provided between said rod core and said filter jacket and/or said rod jacket and said filter core in the zone joins said rod core wrapping and said filter core wrapping.

2. Description of the Related Art

Coaxial cigarettes are designed and produced to enable the smoking and puffing performance to be influenced to a greater extent by the design configuration of the cigarette. One option with coaxial cigarettes is separate treatment of the flows from the rod jacket and the rod core of the coaxial rod through the filter jacket and filter core of the coaxial filter.

In the production of coaxial filter cigarettes, the same as in the production of usual filter cigarettes, the filter is placed up against the rod where it is secured in place by means of a tipping paper placed thereon. This automatically results in coaxial cigarettes having gaps between the end of the rod core wrapping on the filter side and the end of the filter core wrapping on the rod side. Considered microscopically, i.e. when taking into account the flow paths of smoke particles approximately 0.1 mm in size these gaps are to be viewed as being decidedly substantial.

This means that when a separate treatment of the smoke streams from the corresponding rod segments is intended, i.e. when the smoke from the rod jacket is to pass exclusively through the filter core and the smoke from the rod core is to pass exclusively through the filter jacket, then suitable measures need to be taken in accordance with prior art to prevent mis-directed flow through the gaps. As a result of this, coaxial cigarettes known hitherto are subject to heavy restrictions since the flow resistances of the jackets and cores of rod and filter need to be precisely matched. This results in significant restrictions as regards the packing densities achievable in the rod, the usable grade or of other blend components, the coaxial filter employed as well as the achievable condensate target values.

SUMMARY OF THE INVENTION

It is the object of the present invention to provide a coaxial cigarette which overcomes the disadvantages of prior art as cited above. More particularly, the intention is to eliminate cross-flow of the smoke between rod core and filter jacket or between rod jacket and filter core without having to put up with the restrictions in configuring the cigarette.

This object is achieved in accordance with the invention by providing a smoke flow stopper between the rod core and the filter jacket and/or the rod jacket and the filter core in the zone joining rod core wrapping and filter core wrapping.

A smoke flow stopper in accordance with the invention prevents a mis-directed flow from the rod core into the filter jacket or from the rod jacket into the filter core, thus constructively engineering the location where cross-flows may occur, namely at the gap separating the end of the rod core wrapping on the filter side from the end of the filter core wrapping on the rod side. This gap is closed so that it is no longer necessary to influence flow control by employing specific tobacco or tobacco replacement materials and filter materials in special configurations of the puff resistances. Materials may now be used over a broader bandwidth as well as desired condensate target values achieved.

When the filter core wrapping and the rod core wrapping feature substantially the same diameter it is possible in one advantageous embodiment of the smoke flow stopper to gaplessly join the two wrappings at their point of contact.

In a first group of embodiments of the coaxial cigarette in accordance with the invention the rod core wrapping and the filter core wrapping are configured integrally, the filter to advantage being configured at least in part as a tobacco filter, whereby the filter jacket and/or the filter core are engineered in a tobacco material having a tobacco packing density modified relative to the associated rod portion. In this arrangement the complete cigarette is produced, for example, as a coaxial rod of tobacco. In the filter zone either the packing density of a rod segment or of an associated tobacco filter segment is increased so that the filtration coefficient of at least one of the filter segments differs from the filtration coefficient of the associated tobacco rod segment. Producing such a cigarette is simple in fast on-line operation.

In a second option the inner rod is formed by a train of filter cigarettes in the diameter of the coaxial cigarette core. The filter cigarettes are joined analogously to filter and rod bonding into an endless rod and the rod and filter jacket consisting of tobacco.

Producing this cigarette too, is possible with existing cigarette production technology in fast on-line operation.

One possibility of producing a gapless joint for substantially the same diameter of the core segments in a further embodiment of the invention consists of joining the rod core and filter core to each other in the joining zone by means of a wrapping, preferably of tipping paper. The wrapping covers the gap, i.e. the junction between the two core wrappings sealing it off against mis-directed flows.

To enable a wrapping to be applied to the juncture cross-section of the core wrappings, they need to be stripped of part of the jacket in production. After rod core and filter core have been joined together and wrapped a longitudinal gap materializes in the jacket which can be left empty, i.e. merely needing to be closed by the tipping paper. Advantageously, however, the rod jacket and the filter jacket may also be filled with a tobacco or filter material in the region of the wrapping, this making for a further possibility of engineering smoke flow performance.

A further group of embodiments of the coaxial cigarettes in accordance with the invention is not aimed at gaplessly closing the junction between rod core wrapping and filter core wrapping. It instead makes use of the flow paths of the smoke flow or its predetermined direction and attaining the smoke stopper by the rod core and the filter core being provided differing in diameter and the wrapping of the filter core protruding by a defined distance into the rod core or rod jacket. The difference in diameter between the outer diameter of the filter core wrapping and the inner diameter of the rod core wrapping must be so small that the flow resistance materializing between the wrappings is so high that no smoke is able to flow between the wrappings, as a result of which a smoke flow stopper likewise materializes. Should the filter core have a smaller diameter than the rod core, the protruding portion of the filter core wrapping locates within the rod core when filter and rod are joined together. The two core wrappings form in the overlapping region a recess. In the aforementioned example it can then be prevented that smoke gains access from one radial segment into the other.

As regards separate treatment of the smoke flow the aforementioned embodiment thus acts in one direction in each case, blocking any cross-flow from the rod core into the filter jacket or from the rod jacket into the filter core.

The invention relates further to a method of producing a coaxial cigarette with said rod jacket and filter jacket being left empty in said region of said wrapping or filled with a tobacco or filter material. Configuring the smoke flow stopper preferably as an engineered smoke flow stopper has the advantages as already described for the coaxial cigarette in accordance with the invention.

In one preferred embodiment of the method in accordance with the invention the rod core wrapping and the filter core wrapping are configured integrally, the filter being configured at least in part as the tobacco filter and the filter jacket and/or the filter core being configured of a tobacco material having a tobacco packing density modified relative to the associated rod portion. As already described above such a tobacco filtering principle is of advantage as regards on-line production.

A further aspect of the method in accordance with the invention is characterized by the rod core and the filter core being gaplessly joined to each other in the juncture zone by means of a wrapping, preferably a tipping paper. As likewise discussed as regards the corresponding cigarette in accordance with the invention the rod jacket and the filter jacket may be left empty in the region of the wrapping or filled with a tobacco or filter material, for example with granulate or non-woven fabric filter.

An alternative embodiment of the method in accordance with the invention consists of producing the rod core and the filter core slightly differing in diameter and configuring the wrapping of the filter core to protrude so that it juts into the rod core or rod jacket when rod and filter are joined.

BRIEF DESCRIPTION OF THE DRAWINGS

The invention will now be detailed with respect to the accompanying drawings depicting various embodiments of a coaxial cigarette in accordance with the invention and in which.

DESCRIPTION OF THE PREFERRED EMBODIMENTS

Figure 1:
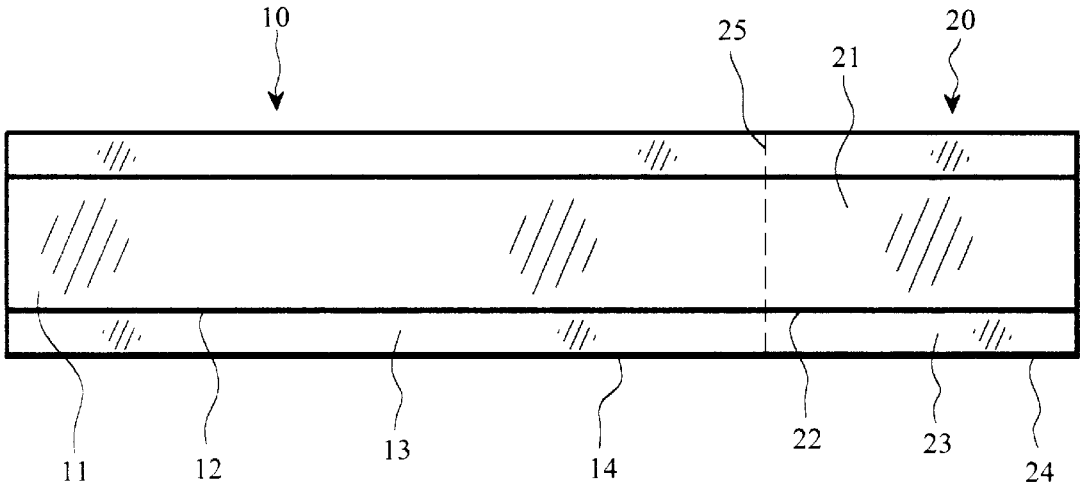
FIG. 1 is an illustration of a coaxial cigarette in accordance with the invention having a tobacco filter.

Referring now to FIG. 1 there is illustrated what is probably the simplest configuration of a cigarette in accordance with the invention having a cross-flow stopper, namely comprising a tobacco filter. The cigarette consists of a rod 10 and a filter 20. The rod is composed of a rod core 11, a rod core wrapping 12, a rod jacket 13 and a rod jacket wrapping 14. The filter consists correspondingly of a filter core 21, a filter core wrapping 22, a filter jacket 23 and a filter jacket wrapping 24. The cores 11, 21 and jackets 13, 23 are each the same in diameter, i.e. coaxial.

Figure 2:
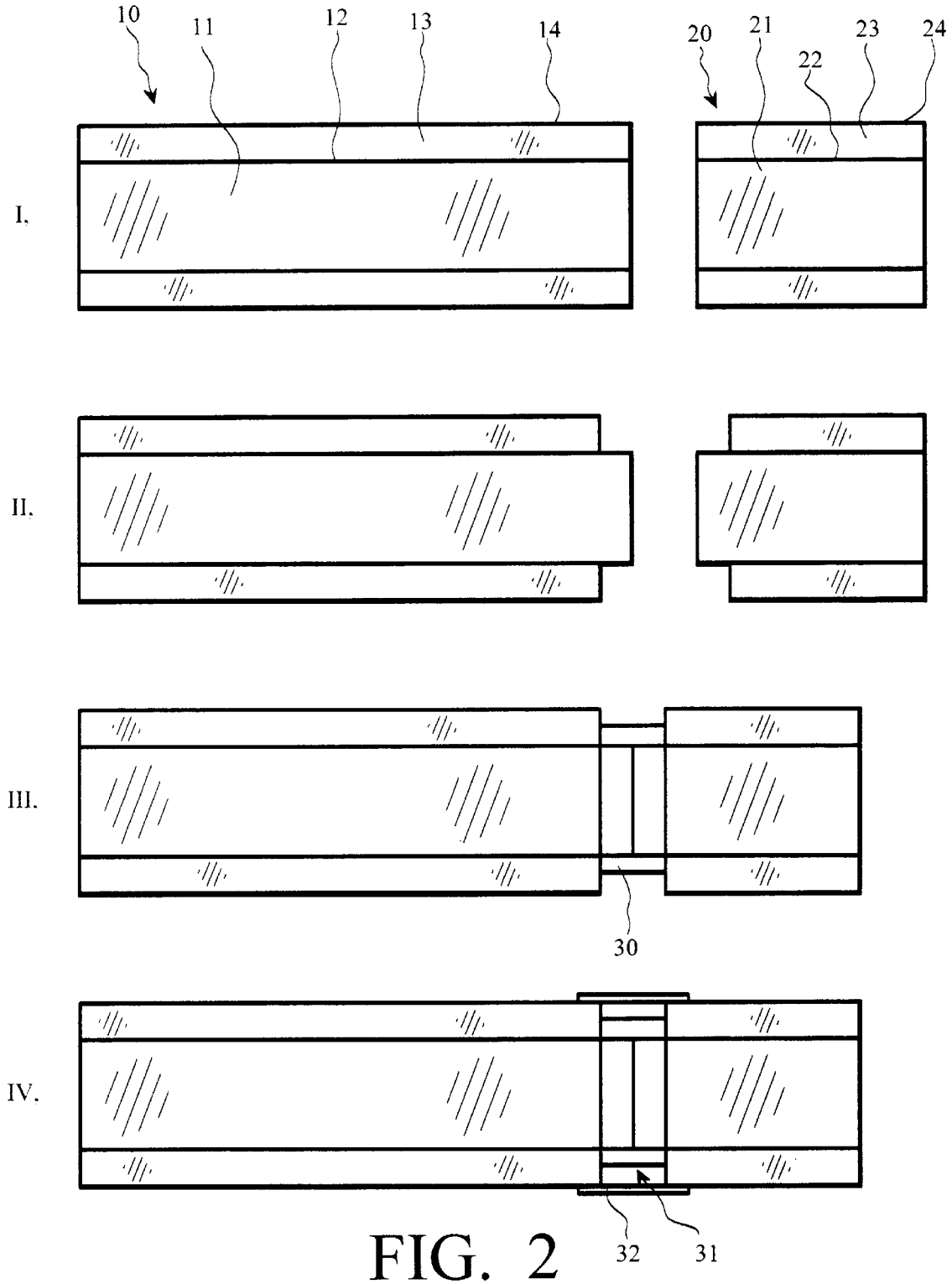
FIG. 2 is an illustration of the sequence in producing a coaxial cigarette in accordance with the invention having a wrapping about the juncture of rod core wrapping and filter core wrapping.
Figure 3:
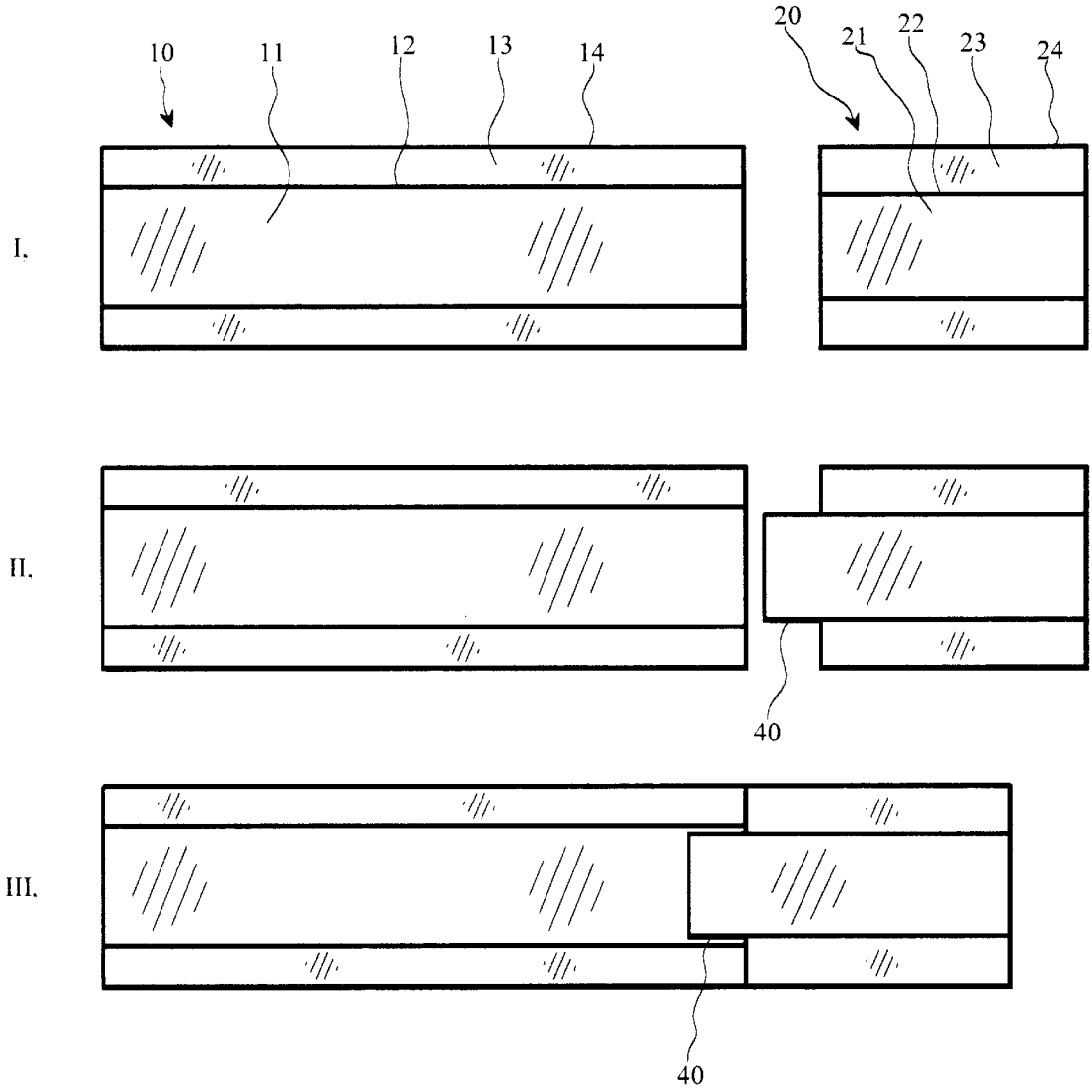
FIG. 3 is an illustration of the procedure in producing a coaxial cigarette having an overlapping wrapping of the rod core and filter core.

It is to be noted that the above assignment of reference numerals applies likewise to the FIGS. 2 and 3.

The coaxial cigarette having the tobacco filter 20 as shown in FIG. 1 is produced in all as a coaxial rod of tobacco. The broken line 25 denotes in this case not a parting line indicating for instance an applied filter, but where in this cigarette having the tobacco filter 20 tobaccos exist on both sides having differing properties. These differing tobacco properties on both sides of the broken line 25 are the reason for the differing properties of the rod 10 and filter 20.

The coaxial cigarette as shown in FIG. 1 is provided with the filter jacket wrapping 24. The wrapping 24 may contain a ventilation zone. The portion of the coaxial cigarette below the filter jacket wrapping 24 acts as a filter 20. The filter coefficient of at least one of the two filter segments (filter core 21 or filter jacket 23) differs from the filter coefficient of the associated tobacco rod segment (rod core 11 or rod jacket 13). This is achieved by the use of corresponding seepage disks in production, i.e. analogously to the so-called "end reinforcement" procedure. Depending on the desired function either the packing density of one of the rod segments 11, 13 or that of the associated filter segments 21, 23 is "reinforced". By setting the packing density in the corresponding component parts of the coaxial cigarette a precisely defined filter effect may be achieved. Since it is produced in all as a coaxial rod of tobacco the filter cigarette comprises no gaps in the border-line zone between the rod core wrapping 12 and the filter core wrapping 22 due to the wrappings 12, 22 being configured integrally for both of these segments 11, 21, as a result of which the smoke from the corresponding rod segment may be treated separately in the corresponding filter segment, i.e. smoke from the rod core I1 gains access only to the filter core 21 and smoke from the rod jacket 13 gains access only to the filter jacket 23.

The coaxial cigarette as shown in FIG. 1 may be additionally provided in the region of the filter 20 with tipping paper.

Referring now to FIG. 2 there is illustrated a method of producing a coaxial cigarette comprising a separately produced coaxial rod 10 and a coaxial filter 20 likewise produced separately.

Illustrated are the steps I to IV in production. In step I the assembly still consists of a coaxial tobacco rod 10 and a coaxial filter 20. The rod core 11 has substantially the same diameter as the filter core 21.

In joining the rod 10 and filter 20 the wrapping 30 of the portion joining the rod core wrapping 12 and the filter core wrapping 22 is applied, it acting as a smoke stopper.

For this purpose a portion of the rod jacket 13 on the filter side is removed with the wrapping 14 in step II. In the same way an outer ring is removed from the filter 20 on the rod side by cutting off the filter jacket 23 together with the filter jacket wrapping 24 so that at the juncture only the cores 11, 21 together with their wrappings 12, 22 remain in each case. A ring approximately 2 to 4 mm long is removed in each case.

In step III the cores 11, 21 are butt-jointed and wrapped with a tipping paper 30. The tipping paper 30 is bonded, rendering it impervious to smoke.

Thus, the smoke flow stopper in accordance with the invention is already achieved in step III, preventing a cross-flow of smoke on both sides at the junction between the rod core and filter core.

After having produced this smoke flow stopper with the tipping paper 30 which may have an axial length of 3.8 to 7.8 mm, the cigarette is then "completed" in step IV, for which several possibilities exist:

In one approach, the gap 31 over the tipping paper may be simply left empty, resulting in a gap width of 4 to 5 mm. For such a cigarette a relatively stiff tipping paper 32 is used as the outer wrapping to ensure an adequate dimensional stability of the cigarette.

In another approach, the gap 31 over the inner tipping paper 30 is filled with tobacco which is then covered by an outer tipping paper 32, the width of the gap 21 in this case being 4 to 8 mm.

In yet a further embodiment the gap over the juncture of the two cores II, 21 may be filled with granulate. The granulate may have an inactive or selective filtering action, as is the case, for example, in one of the known chamber filter materials. The outer circumference of the cigarette is wrapped with the tipping paper 32, the width of the gap 31 in this case being 4 to 8 mm.

Still another conceivable approach in closing the aforementioned gap 31 consists of wrapping it with non-woven fabric filter strips until the outer diameter of the cigarette is achieved, after which in turn a tipping paper 32 is applied around the outer sleeve, the gap width in this "filling method" too being in the range 4 to 8 mm.

In all of the above variants the width of the tipping paper 32 applied surrounding the cigarette, i.e. the filter and the gap 31 on the outside needs to be at least 3 mm longer than the filter length plus the width of the rod jacket removed at the filter side.

The material with which the gap 31 in the remaining jacket region at the rod and filter is filled may be bonded to the wrapping 30.

Referring now to FIG. 3 there is illustrated an alternative possibility of producing a coaxial cigarette in accordance with the invention on the basis of the steps I to III in the method. Illustrated in this case is a coaxial cigarette having a rod 10 and a filter 20 in which the wrappings 12, 22 of the rod and filter core overlap.

Step I shows a coaxial rod 10 and a coaxial filter 20, each of which is prepared separately. The diameter of the rod core 11 is slightly larger than the diameter of the filter core 21.

To produce the cross-flow stopper. as discussed in step II, a rod end ring segment of the filter jacket is removed, for example cut off, this resulting in the filter core 21 having a projection 40 at the side of the rod 10.

As evident from step III for completing the cigarette the filter 20 is placed up against the rod 10 so that the projection 40 enters the rod core portion 11. The wrapping 12 of the rod core and the projection 40 thereby overlap over a specific length.

It will be appreciated that the method of producing the cigarette as shown in FIG. 3 is but one of the many possible variants of the method with which coaxial cigarettes having a cross-flow stopper may be produced.

The zone free of material at the end the filter core on the rod side may be produced in several ways, namely, for example, by stuffing the filter material or by cutting out/milling the filter material. The projection 40 may be configured in both the filter maker and during attachment to the filter.

The projection 40 may be produced by the methods as described above at both the rod and tip side of the filter 20. The zone free of material over the filter core 21 should have a width of 2 to 5 mm.

The diameter of the rod core 11 must be larger than the diameter of the filter core 21 (FIG. 3) i.e. merely sufficient so that the filter core is just able to be plugged into the tobacco core.

In the embodiment variants in which the projection 40 is configured at the rod side, the projection 40 is plugged into the tobacco rod, in joining rod 10 and filter 20, so that the filter core wrapping 22 slips under the wrapping 12 of the rod core 11 and closes off the filter jacket 23 at the rod side by the rod jacket 13 at the filter side. The filter core wrapping or the outer portion of the projection 40 may be bonded to the material of the filter jacket.

If the projection 40 is produced at the tip side of the filter 20 the projection 40 is plugged into the filter 20 in joining rod 10 and filter 20, until it concisely closes off the tip end. In this case too, the filter core wrapping 22 slips under the wrapping 12 of the rod core 11. In these variants the material of the filter jacket 23 is no longer bonded to the wrapping 22 of the filter jacket 21, the core 21 instead being joined to the jacket 23 simply by a pressure/friction connection.

To facilitate plugging the filter core 21 into the tobacco rod 11 the filter wrapping 22 consists preferably of a film of cellulose acetate preferably 0.1–0.2 mm thick.

In all variants the length of the filter tip paper needs to be at least 3 mm longer than the filter length plus the width of the projection 40.

What is claimed is:

1. A coaxial cigarette including a rod comprising a rod core, a rod core wrapping, a rod jacket and a rod jacket wrapping; and a filter comprising a filter core, a filter core wrapping, a filter jacket and a filter jacket wrapping, wherein a smoke flow stopper is provided that covers both a portion of the filter core wrapping and the rod core wrapping; or said rod core and said filter core differ in diameter, said filter core having a smaller diameter than said rod core, and wherein said wrapping of said filter core protrudes into said rod core when the filter and the rod are joined together.

2. The coaxial cigarette as set forth in claim 1, wherein said rod core wrapping and said filter core wrapping are gaplessly joined to each other.

3. The coaxial cigarette as set forth in claim 2, wherein said rod core wrapping and said filter core wrapping have substantially the same diameter.

4. The coaxial cigarette as set forth in claim 1, wherein said rod core wrapping and said filter core wrapping are configured integrally.

5. The coaxial cigarette as set forth in claim 1, wherein said filter is configured at least in part as tobacco filter, with at least one of said filter jacket and said filter core consisting of a tobacco material having a tobacco packing density modified relative to that of the associated rod portion.

6. The coaxial cigarette as set forth in claim 5, wherein said rod core and said filter core with their wrappings are formed by a thin cigarette having a conventional cigarette filter, whilst rod and filter jackets consist of a tobacco material.

7. The coaxial cigarette as set forth in claim 5, wherein said filter core and said filter jackets as joined filter parts consist of a tobacco material.

8. The coaxial cigarette as set forth in claim 1, wherein said rod core and said filter core are gaplessly joined to each other by means of a wrapping.

9. The coaxial cigarette as set forth in claim 8, wherein said wrapping consists of tipping paper.

10. The coaxial cigarette as set forth in claim 8, wherein said rod jacket and filter jacket are left empty in the region of said wrapping.

11. The coaxial cigarette as set forth in claim 8, wherein said rod jacket and filter jacket are filled with a tobacco or filter material in the region of said wrapping.

12. A method of producing a coaxial cigarette comprising the following steps:

configuring a rod comprising a rod core, a rod core wrapping, a rod jacket and a rod jacket wrapping; and configuring a filter comprising a filter core, a filter core wrapping, a filter jacket and a filter jacket wrapping, wherein a smoke flow stopper is configured that covers both a portion of the filter core wrapping and the rod core wrapping, or said rod core and said filter core are produced different in diameter, said filter core having a smaller diameter than said rod core and wherein said wrapping of said filter core is configured so the protruding portion of the filter core wrapping is located within said rod core when said rod and said filter are joined together.

13. The method as set forth in claim 12, wherein said rod core wrapping and said filter core wrapping are configured integrally, said filter being configured at least in part as tobacco filter and at least one of said filter jacket and said filter core consisting of a tobacco material having a tobacco packing density modified relative to that of said associated rod portion.

14. The method as set forth in claim 13, wherein said rod core and said filter core with their wrappings are formed by a thin cigarette having a conventional cigarette filter, whilst rod and filter jackets are applied as tobacco material onto said thin cigarette.

15. The method as set forth in claim 12, wherein said filter core and said filter jacket are placed as filter parts of tobacco material against the corresponding rod part.

16. The method as set forth in claim 12, wherein said rod core and said filter core are gaplessly joined to each other by means of a wrapping.

17. The method as set forth in claim 16, wherein said wrapping consists of tipping paper.

18. The method as set forth in claim 16, wherein said rod jacket and said filter jacket are left empty in the region of said wrapping.

19. The method as set forth in claim 16, wherein said rod jacket and said filter jacket are filled with a tobacco or filter material in the region of said wrapping.

20. The method as set forth in claim 19, wherein said rod jacket and said filter jacket are filled with granulate or with non-woven fabric filter strips.

* * * * *